US009505512B2

(12) United States Patent
Havens et al.

(10) Patent No.: US 9,505,512 B2
(45) Date of Patent: Nov. 29, 2016

(54) SHEET GOOD LOADING DEVICE AND METHOD OF LOADING SHEET GOODS

(75) Inventors: Brian D. Havens, Liberty Township, OH (US); David Stuart Howell, II, Washington Township, OH (US); Sabrina Xiumin Xie, Mason, OH (US); Donald M. Radford, Jr., Reading, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1093 days.

(21) Appl. No.: 13/325,119

(22) Filed: Dec. 14, 2011

(65) Prior Publication Data

US 2013/0152513 A1 Jun. 20, 2013

(51) Int. Cl.

| | |
|---|---|
| ***B65B 55/18*** | (2006.01) |
| ***B65B 55/22*** | (2006.01) |
| ***B65B 43/26*** | (2006.01) |
| ***B65B 25/14*** | (2006.01) |
| ***B65B 39/00*** | (2006.01) |
| ***B65B 5/10*** | (2006.01) |

(52) U.S. Cl.

CPC ..... *B65B 43/26* (2013.01); *B65B 5/108* (2013.01); *B65B 25/14* (2013.01); *B65B 39/007* (2013.01)

(58) Field of Classification Search

CPC ... B65B 43/145; B65B 21/245; B65B 25/14; B65B 43/26

USPC ..... 53/431, 432, 471, 485, 488, 489, 510, 53/511, 545, 562, 281

See application file for complete search history.

(56) References Cited

U.S. PATENT DOCUMENTS

| | | | | |
|---|---|---|---|---|
| 2,994,997 | A | | 9/1961 | Gwinn et al. |
| 3,319,394 | A | | 5/1967 | Ottaway et al. |
| 3,837,138 | A | | 9/1974 | Terry |
| 4,062,169 | A | | 12/1977 | Lister et al. |
| 4,156,336 | A | * | 5/1979 | Tabaroni et al. ..... 53/562 |
| 4,408,437 | A | | 10/1983 | Crouch et al. |
| 4,510,737 | A | * | 4/1985 | Ellert ..... B65B 43/123 53/255 |
| 4,676,050 | A | * | 6/1987 | Odenthal ..... B65B 5/101 53/171 |
| 4,691,835 | A | * | 9/1987 | Mueller ..... 215/246 |
| 4,738,078 | A | | 4/1988 | Benz et al. |
| 4,751,807 | A | | 6/1988 | Couturier |
| 4,858,416 | A | | 8/1989 | Monaghan |

(Continued)

FOREIGN PATENT DOCUMENTS

| | | | |
|---|---|---|---|
| GB | 1417082 | A | 12/1975 |
| GB | 1491844 | A | 11/1977 |

*Primary Examiner* — Robert Long

(74) *Attorney, Agent, or Firm* — Larry L. Huston; Steven W. Miller

(57) ABSTRACT

A device for loading deformable objects into a flexible container. The objects are controlled from a remote source point at least partially into the container. The device provides for simultaneous movement of fingers, between which the objects travel, in mutually orthogonal X, Y and Z directions.

14 Claims, 6 Drawing Sheets

(56) References Cited

U.S. PATENT DOCUMENTS

| | | | | | |
|---|---|---|---|---|---|
| 4,892,124 | A * | 1/1990 | Thomsen | B65B 43/123 | 141/114 |
| 5,022,216 | A | 6/1991 | Muakenfuhs et al. | | |
| 5,129,778 | A * | 7/1992 | Harp | B65G 7/06 | 180/125 |
| 5,177,936 | A * | 1/1993 | Myers | B65B 7/26 | 53/250 |
| 5,239,809 | A * | 8/1993 | Long | B65B 35/243 | 198/626.6 |
| 5,443,150 | A * | 8/1995 | Buchko | B26D 1/045 | 198/463.3 |
| 5,564,259 | A * | 10/1996 | Stolmeier | 53/410 | |
| 5,588,285 | A * | 12/1996 | Odenthal | B65B 5/101 | 53/171 |
| 5,871,433 | A | 2/1999 | Lehmam et al. | | |
| 5,897,292 | A * | 4/1999 | Gerwe et al. | 414/798.4 | |
| 5,979,145 | A | 11/1999 | Louis et al. | | |
| 6,223,500 | B1 | 5/2001 | Kramps | | |
| 6,658,819 | B2 | 12/2003 | Gamberini | | |
| 6,708,465 | B1 | 3/2004 | Gustafsson | | |
| 6,732,492 | B2 | 5/2004 | Osborne et al. | | |
| 6,840,025 | B1 | 1/2005 | Chapman | | |
| 7,213,386 | B2 * | 5/2007 | Hooper | B65B 5/08 | 198/419.3 |
| 7,510,756 | B2 * | 3/2009 | Ribi | 428/138 | |
| 7,584,593 | B2 | 9/2009 | Murray | | |
| 8,689,530 | B2 * | 4/2014 | Prahm | B65B 5/061 | 53/247 |
| 2008/0029517 | A1 * | 2/2008 | Briers | B65D 25/06 | 220/495.01 |
| 2010/0105783 | A1 * | 4/2010 | Lee et al. | 514/777 | |

* cited by examiner

SHEET GOOD LOADING DEVICE AND METHOD OF LOADING SHEET GOODS

FIELD OF THE INVENTION

The present invention relates to a device for loading sheet goods into a container and more particularly to a device for loading sheet goods into a flexible container.

BACKGROUND OF THE INVENTION

Deformable objects, such as pads, sheets, clothing, etc. (generally sheet goods) are frequently sold in deformable containers or other packaging. For example, shirts are sold in polyethylene film package containers.

But disposing deformable objects in deformable packaging presents challenges. For example, a container may have an opening through which the objects are loaded during manufacture, and through which the objects may later be dispensed at the point of use.

If the container moves from the intended position or geometry during loading, one or more objects may not be properly loaded through the opening. Thus the package intended to be loaded with the deformable objects to be contained therein must be properly opened to receive those objects.

Likewise, the deformable objects must be transported from a source location, or other first location, to the package. But this step also presents challenges. The objects cannot be unduly deformed during transport or the objects may be damaged. If the deformable objects are sheet goods, the sheet goods may be torn or otherwise rendered unusable.

If discrete objects are to be disposed in the container, multiple counts may be desired. For example, a container having a first count may contain 12 of the objects, a larger container may contain 23 (or some other uneven multiple) objects, and yet another container may contain a single count of the object. Thus, the device loading the objects must be able to accommodate different counts and changes in those counts.

If the objects are not discrete, e.g. a farinaceous powder, the same rationale applies. Different sized containers with different volumes of product may be desired at the point of manufacture.

Once the desired count of objects is transported to the package, these objects must be loaded into the package. If the objects are dropped into the package, misalignment and improper loading may occur, particularly during high speed operation.

Yet other challenges occur. The container may be loaded with a liquid, in addition to the deformable objects. For example, a container having cleaning sheets therein may be wetted with a liquid cleanser. A container having wipes for the skin may be wetted with a different liquid cleanser. Each such container must be able to contain the deformable objects and such liquids without leaking.

Thus there is a need for improved devices to load deformable objects into deformable containers. Related attempts include U.S. Pat. Nos. 2,994,997; 3,319,394; 3,837,138; 4,062,169; 4,408,437; 4,738,078; 4,751,807; 4,858,416; 5,022,216; 5,979,145; 6,223,500; 6,658,819; 6,708,465; 6,732,492; 7,584,593, EP768267B1; EP1222111B1 and GB1417082A.

SUMMARY OF THE INVENTION

In one embodiment, the invention comprises a device for disposing sheet goods into a flexible container. The device has components moveable in mutually orthogonal X, Y and Z directions. The device comprises: a conveying mechanism for conveying flexible containers in a first predetermined direction; a conveying mechanism for conveying the sheet goods in a second predetermined direction; plural extending fingers, each said finger being cantilevered from a proximal end to a distal end remote therefrom; and a mechanism for moving the plural fingers in mutually orthogonal X, Y and Z directions, while said fingers are at least partially inserted into a flexible container.

In another embodiment, the invention comprises a method for disposing sheet goods into a flexible container. The method comprises the steps of: providing a flexible container having an opening for receiving the sheet goods; disposing the sheet goods between opposed members to limit movement of said sheet goods to movement in a first direction; conveying the sheet goods towards said flexible container; disposing said sheet goods between two pairs of opposed fingers, each finger extending from a proximal end to a distal end; moving the fingers in order to dispose the distal ends of the fingers in the flexible container; conveying the sheet goods through the opening and at least partially into the flexible container; moving the fingers away from each other, so that each said finger moves away from other said fingers, to thereby expand the opening of the flexible container; and inserting the sheet goods into the flexible container. Of course sheet goods are used herein for illustrative purposes and the invention is not so limited, except as claimed.

DETAILED DESCRIPTION OF THE INVENTION

Figure 1A:
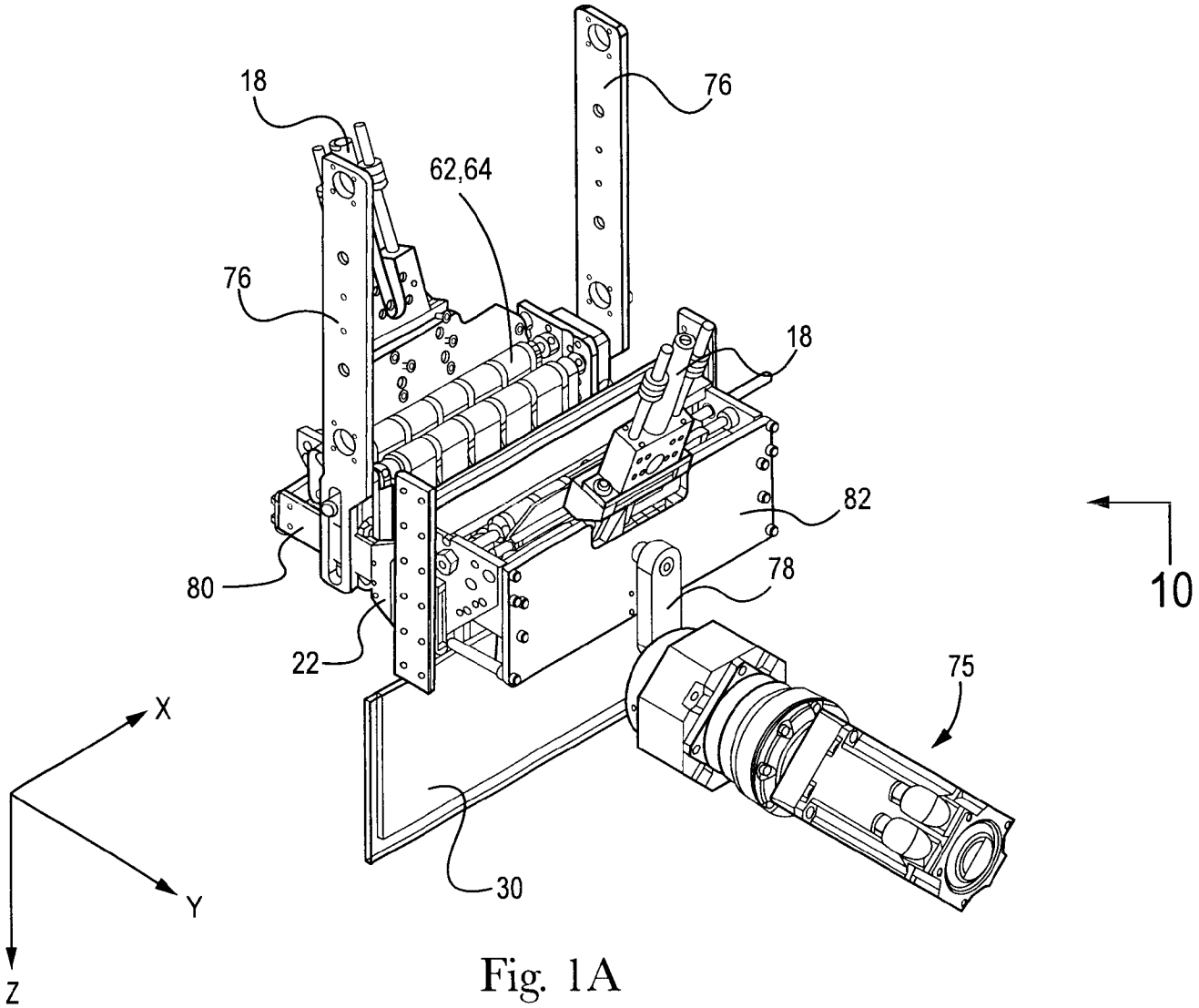
FIG. 1A is a perspective view of a device according to the present invention.
Figure 1B:
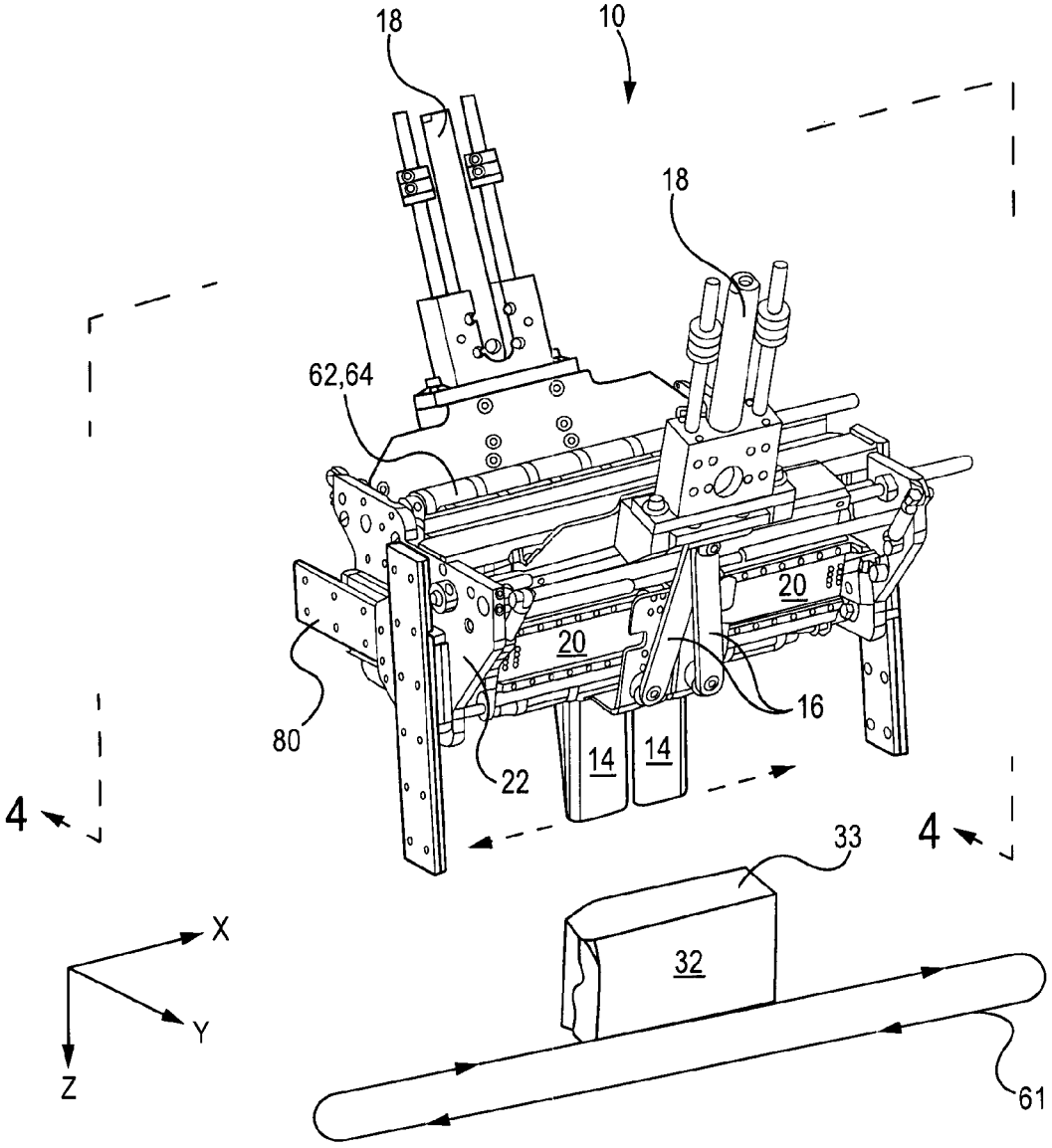
FIG. 1B is a perspective view of the device of FIG. 1A, with the drive and vertical rails eliminated for clarity and having a schematic first conveying mechanism.

Referring to FIGS. 1A and 1B, the device 10 of the present invention comprises a first conveying mechanism 61 for moving a container 32 along a first predetermined path, a second conveying mechanism 62 for moving sheet goods along a second predetermined path, and a plurality of fingers 14 for opening 33 the container 32.

The device 10 is usable with a container 32 for receiving, storing and transporting deformable objects. The invention is described below with respect to having sheet goods represent discrete deformable objects, although the invention is not so limited, except as specifically claimed herein.

The sheet goods may be stored and transported in the container 32 until ready for dispensing/use by a user. The container 32 may be a pouch, as is known in the art and does not form part of the present invention, except as specifically claimed herein. A pouch may have a reclosable and openable opening 33 for receiving sheet goods into and dispensing the sheet goods from the container 32.

During the operation and method described herein, the opening 33 may be disposed upwardly, at or near the top of the container 32. This arrangement provides the benefit that once sheet goods, and/or ancillary and related items are disposed within the container 32, there is less chance of spillage, etc., until the container 32 is sealed.

The container 32 may be flexible. By flexible, it is meant that the sides of the container 32 can be manipulated by the device 10, without undue strain or tearing. A pouch execution of the container 32 described herein may comprise a polyolefinic film. Particularly, the container 32 may comprise LDPE sides and a resealable closure, as are known in the art.

The container 32 may comprise flaccid sidewalls. The container 32 may be generally parallelepipedal or any other suitable shape. The shape and size of the container 32 may be suitable to provide for loading, containing, transport and dispensing of the desired sheet goods. The container 32 may have two opposed major panels. The size of the container 32 may influence, if not dictate, the size of the fingers 14 described below.

The sheet goods usable with the device 10 of the present invention may have any number of functionalities for the user. For example, the sheet goods may comprise a floor cleaning sheet, as sold by the instant assignee under the Swiffer® brand. Such a floor sheet may be used dry, wet and/or may be wettable to absorb liquids separately dispensed on the target surface. Alternatively, the sheet goods may comprise one or more wipes. Such a wipe may be usable for cleaning the skin of an infant, removing makeup, wiping a hard surface such as a countertop, cleaning a soft surface, such as fabric, etc. Of course, there are other functionalities, not encompassed by aforementioned non-limiting examples.

Each individual sheet may be disposed in proximity to an adjacent sheet and to the container 32 opening 33. The sheet goods may be individually dispensed by reach-in dispensing, as is known in the art. Alternatively, the sheet goods may be dispensed by pop-up dispensing, as is known in the art.

Examining the invention in more detail, a plurality of containers 32 may be provided, in known fashion. The containers 32 may be moved in a first direction by a first conveying mechanism 61, as is known in the art. For example, pouch containers 32 may be provided in a stack, and individually disposed on the conveying mechanism. The first conveying mechanism 61 may index the containers 32 so that an empty container 32 is staged immediately before the device 10, then indexed to be within the operable domain of the device 10, then indexed again to be outside and beyond the device 10. The operable domain of the device 10 is considered that region of the device 10 in which sheet goods may be loaded into the container 32.

Indexing of the containers 32 may be performed by the first conveying mechanism 61 in known fashion, not critical to the present invention. The container 32 may dwell in position long enough to provide for loading of at least one sheet good therein, and to perform any other operation deemed necessary or desirable.

Figure 2:
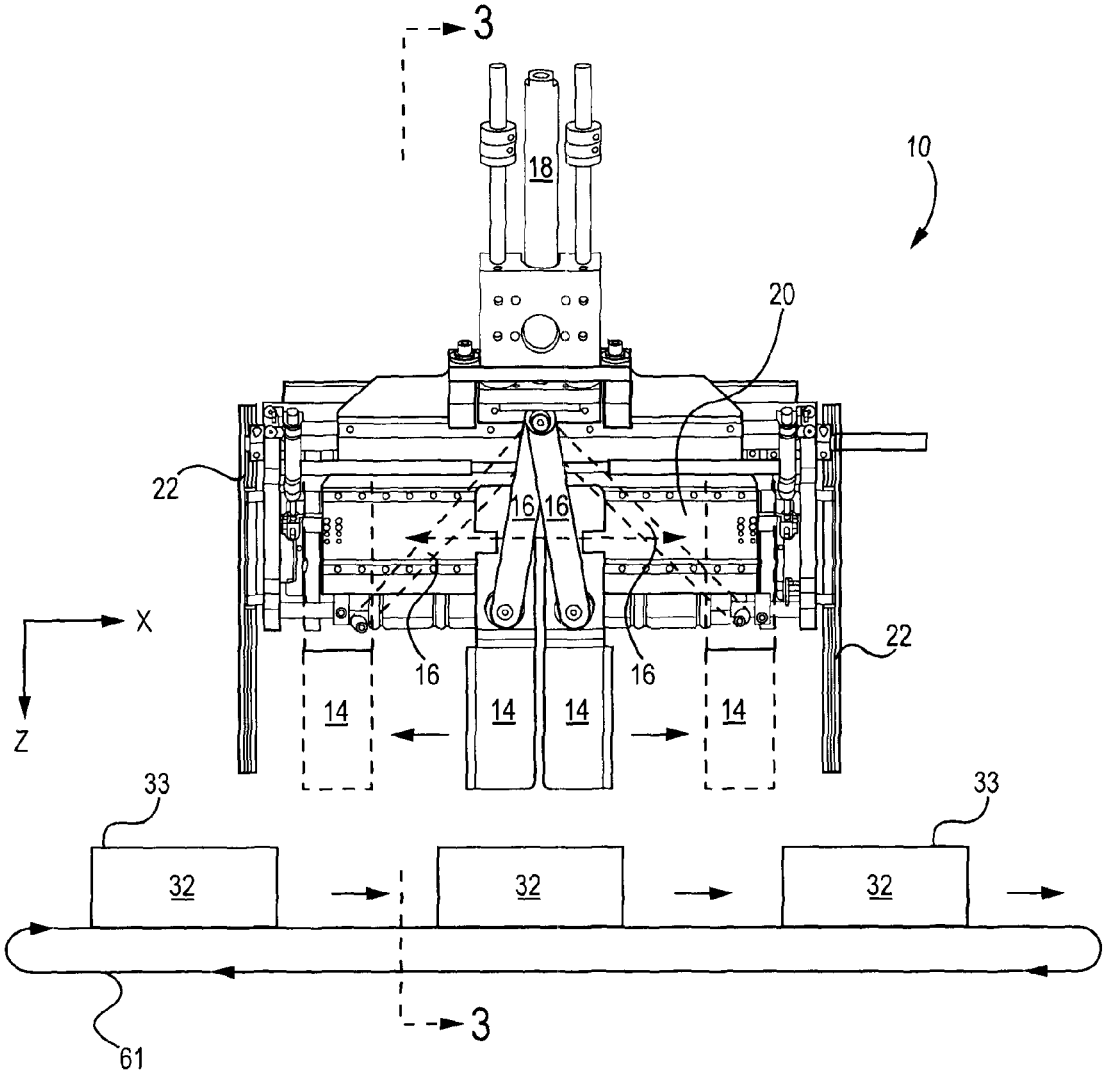
FIG. 2 is a side elevational view of the device of FIG. 1B, showing the fingers in a closed X position in solid and in an open X position in phantom.

Referring to FIG. 2, the containers 32 may be indexed in a direction herein referred to as the X-direction. As noted below, the X-direction may be parallel to the direction of translation of individual fingers 14 in a finger 14 pair towards and away from the other finger 14 of that pair.

Once the container 32 is loaded with sheet goods, and moved outside of the operable domain of the device 10, additional and optional operation(s) may be performed on the sheet goods and/or container 32. For example, liquid, such as cleanser, perfume, disinfectant, etc. may be added to the container 32. A sealable closure may be added to the container 32, the container 32 may be closed, instructions for use or other decoration may be added to the container 32, etc.

The sheet goods, or other products to be loaded into the container 32, may be moved by a second conveying mechanism 62. The sheet goods may be provided in a clip 30, having a plurality of the sheet goods or even a single sheet good, such as a pad or cleaning sheet. Using a clip 30 provides the benefit of flexibility in manufacture, particularly, that different quantities of product may be loaded into a single container 32, as desired. The manufacturer need only change the amount of products in the clip 30 and correspondingly adjust the spacing between the belts 64.

The second conveying mechanism 62 is the clip 30 conveying mechanism and may comprise one or more opposed belts 64. The opposed belts 64 may be juxtaposed, to provide a spaced therebetween. The space is wide enough to accommodate the clip 30 of sheet goods therebetween, and frictionally hold the clip 30 in place so that it may be moved by the conveying mechanism, without damage or undue compression.

Figure 3A:
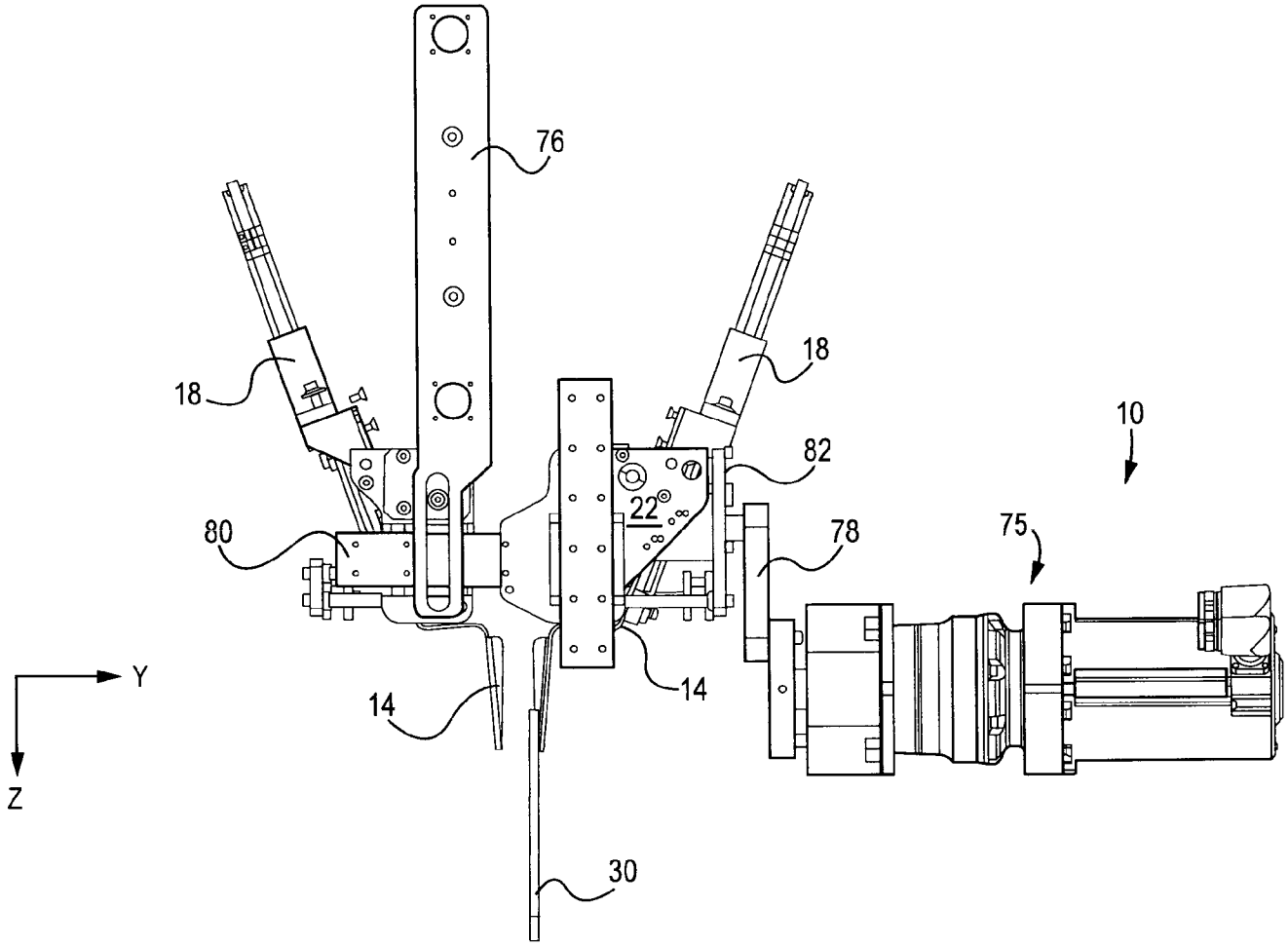
FIG. 3A is a side elevational view of the device of FIG. 1A, taken in the YZ plane.
Figure 3B:
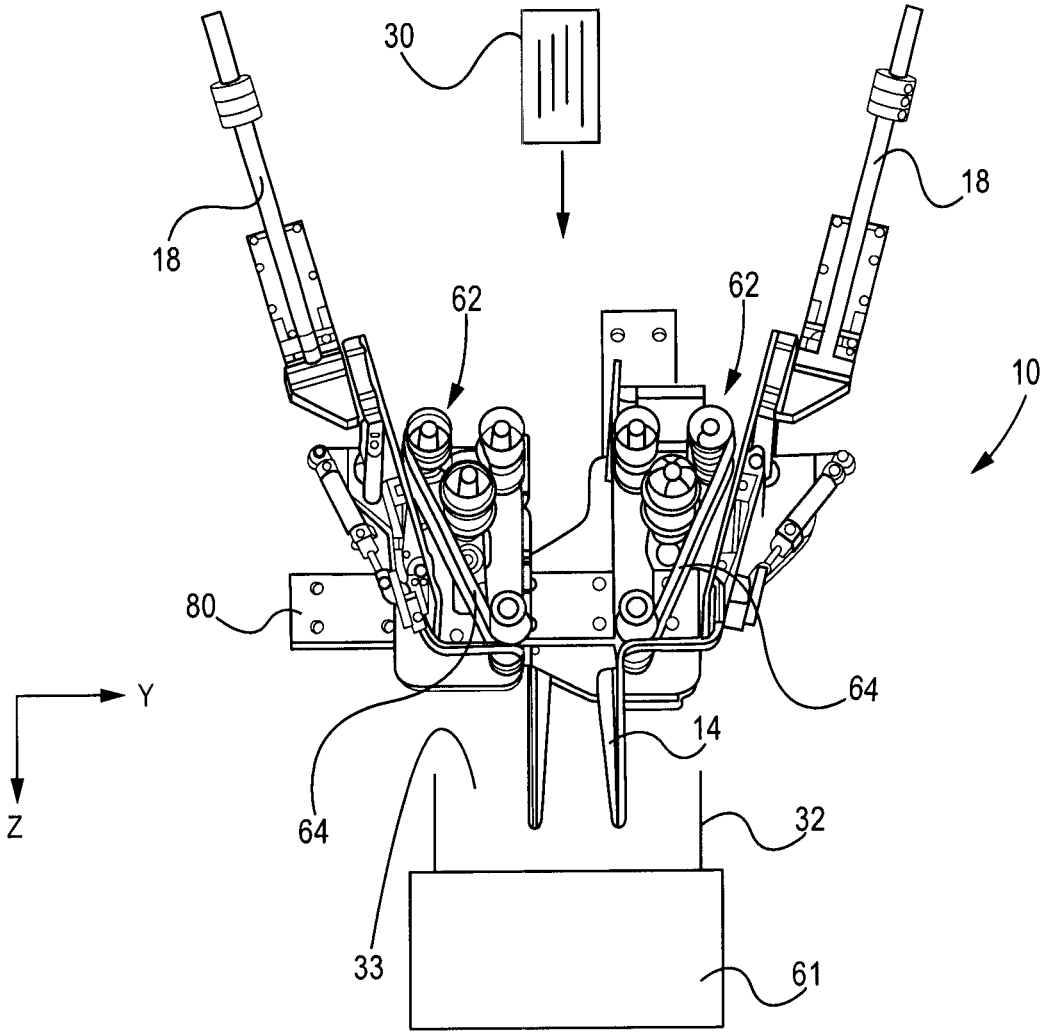
FIG. 3B is a sectional view in the YZ plane, taken along line 3-3 of FIG. 2, showing the fingers inserted into a container and a clip entering the device from above, and not showing the first conveying mechanism for clarity.

Referring to FIGS. 3A and 3B, if desired, the second conveying mechanism 62 may comprise multiple pairs of belts 64, each pair being juxtaposed to provide a space therebetween. The pairs of belts 64 may be longitudinally arranged in series, so that a clip 30 is convey from a first pair of opposed belts 64, to a second pair of opposed belts 64, to a third pair of opposed belts 64, etc. This arrangement provides the benefit that the belts 64 may be disposed to convey the pads in different directions within a common plane.

If desired, an opposed pair of belts 64 may comprise plural belts 64 on each side of the pair. This arrangement provides the benefit that a wider path for conveying the clip 30 may be provided. The wider path provides the benefit that a larger sheet good, slight misplacement of the sheet good on the conveying mechanism, etc. may be accommodated.

The first conveying mechanism 61 may transport the flexible containers 32 in a first direction. The containers 32 may be indexed to dwell in position while loaded with the sheet goods. The second conveying mechanism 62 may transport the clips 30 in a second direction. The first direction and second direction may be skewed relative to the other. In a degenerate case the first direction and second direction may be mutually perpendicular. The second conveying mechanism 62 may be disposed above the first conveying mechanism 61, so that clips 30 may be gravity assisted to move from the second conveying mechanism 62 to the first conveying mechanism 61.

As noted, the second conveying mechanism 62 has a space in the Y direction between the opposed belts 64 to allow conveying of the clip 30 therebetween. The width of such space may be adjusted to provide for different widths of clips 30. If the sheet goods, or other objects, making up the clip 30, are of different sizes in the XZ plane, such sizes can be accommodated through the size of second conveying mechanism 62.

But if the width of the clip 30 in the Y direction is too large for the space between opposed belts 64, the clip 30 will not be controlled in its path to the container 32. Slippage or even dropping of the clip 30 may occur. If the width of the clip 30 in the Y direction is too small for the space between opposed belts 64, the clip 30 will not properly fit. Damage to the sheet goods may occur, or the clip 30 may jam between the belts 64.

The device 10 of the invention may provide for adjustment in the Y direction, and may particularly provide for multiple widths of spacing between opposed belts 64 in the Y direction. In a degenerate case the Y direction may be horizontal. Such spacing may be accomplished by providing two opposed tracks 80. The balance of device 10 is disposed between the tracks 80. Prophetically, the 10 may be cantilevered from a single track 80.

One or both of the carrier plates 20 may be movable on the tracks 80. The other carrier plate 20 may be stationary or moved in concert with the first carrier plate 20 to provide the desired spacing. The opposed belts 64 may at least partially move the clip 30 in the Y direction, with the respective and corresponding carrier plate 20. When the desired spacing between opposed belts 64 is achieved, the second conveying mechanism 62 may be locked in place on the tracks 80, so that the desired space width is maintained in operation.

The second conveying mechanism 62 may originate at a first location. The first location may be considered the source of the clip 30 for purposes of the operation and method described herein.

At the first location the clip 30 may be loaded into the conveying mechanism. The paired belts 64 may move the sheet good(s) in one or more directions to a second location. The second location is the destination. The destination location may be the position in the device 10 where the clip 30 is loaded into the container 32. Thus, the conveying mechanism may control the clip 30 through the path and proximate to the container 32.

If desired, the conveying mechanism may control the clip 30 through the opening 33 of the container 32, so that the sheet goods are at least partially, and in a degenerate case entirely, within the container 32. After the sheet good(s) are partially, or completely, loaded into the container 32 the sheet good(s) may be released from contact with and control of the clip 30 conveying mechanism. Control and transport of the sheet good(s) may end when the opposed pair of belts 64 loop back and no longer convey the sheet good(s) in a forward direction. When released from the belts 64, the clip 30 may fall under the influence of gravity to the bottom of the container 32, if not already there.

Maintaining control of the clip 30 until it is at least partially through the opening 33 of the container 32 provides the unexpected benefit that misalignment between the clip 30 and the container 32 can be avoided. Even if such misalignment should occur, the clip 30 can still be completely disposed in the container 32, minimizing loss of any sheet goods which would otherwise fall outside of the container 32.

Control of the clip 30 may occur in the Z direction. In a degenerate case the Z-direction may be vertical. The device 10 may be moved in the Z-direction through motor 75. The motor 75 can elevate or drop the device 10 as it is carried on vertical rails 76. A pair of vertical rails 76 may be provided with the device 10 therebetween, as shown. Prophetically, the device 10 may be cantilevered from a single vertical rail 76. Movement of the mount 22 along vertical rails 76 provides for corresponding movement of the respective carrier plate 20.

Each vertical rail 76 may have a slot therein. The slot allows for controlled movement of the balance of the device 10 in the Z direction, i.e. parallel to the longitudinal axes of the fingers 14.

The motor 75 may be connected to the balance of device 10 through an offset coupling link 78. The coupling link 78 may be articulably joined to elevator plate 82. The balance of the device 10 may ride in the Z-direction on elevator plate 82.

The container 32 must be in the proper position when the clip 30 is released from the second conveying mechanism 62. Thus the first conveying mechanism 61 for the container 32 and the second conveying mechanism 62 for the clip 30 must synchronously operate in concert so that control of the sheet goods by the clip 30 conveyor does not prematurely terminate, resulting in the clip 30 not being properly disposed within the container 32.

Thus, the indexing of the first conveying mechanism 61 to dispose the container 32 at the appropriate and predetermined position in the device 10 and the release of the sheet goods from the second conveying mechanism 62 must be timed to have the sheet goods and container 32 in the right positions at the same time. The container 32 opening 33 is open for loading of the clip 30 therethrough. Release of the clip 30 from the clip 30 conveying mechanism occurs, and may particularly occur after the sheet goods are at least partially disposed within the container 32.

Such timing and indexing may be accomplished using a controller, as is known in the art. Any suitable servomotor type controller may be used to control the mechanisms described herein.

The container 32 opening 33 may be opened and its area maximized in the X direction using plural fingers 14. While four fingers 14 are illustrated, the invention is not so limited. Two, three, five, six, eight, etc. fingers 14 may be utilized. Four fingers 14 provides the benefit that one finger 14 can be disposed in each corner of a generally rectangular opening 33. Three fingers 14 may be used with a generally triangular opening 33, etc.

The four fingers 14 may be disposed in two pairs. One pair of fingers 14 may be juxtaposed with each major side of the container 32. Each finger 14 may extend from a proximal end joined to a carrier plate 20 to distal end remote therefrom. Each finger 14 defines a longitudinal axis from the proximal end to the distal end. The longitudinal axes define a common longitudinal direction. The longitudinal direction may be considered the Z direction as described herein.

Referring back to FIG. 2, each finger 14 may translate towards and away from the other finger 14 of the respective pair. Translation may be accomplished using a rack gear as is known in the art, a linkage 16, etc. If a linkage 16 is selected, as shown, the linkage 16 comprises two elongate links 16. Each link 16 may have two opposed ends, with a pivot juxtaposed with each end. The links 16 may be symmetrically oppositely disposed.

The links 16 may be joined at a respective first end to a common pivot. Each link 16 may be joined at the respective second end to a finger 14. Thus a pair of links 16 may govern movement of a corresponding pair of fingers 14. Each pair of links 16 may move along a plane parallel to a carrier plate 20. The fingers 14 may simultaneously translate outwardly and away from the other finger 14 of that pair, upon translation of the common pivot of the linkage 16 towards the opposed ends of the links 16. Conversely, the fingers 14 may simultaneously translate inwardly and towards the other finger 14 of that pair, upon translation of the common pivot of the linkage 16 away from the opposed ends of the links 16.

The common pivot may be pivotally joined to a cylinder 18. The cylinder 18 may be pneumatic, hydraulic, etc. Alternatively, the common end pivot may be controlled by an electric motor, or another actuating mechanism. The cylinder 18 may have a piston which moves in a cylinder 18 extension direction, causing movement of the links 16 in a different direction and movement of the respective fingers 14 of the corresponding pair in the X direction. The X direction in which the fingers 14 translate may lie in a common plane with and be generally orthogonal to the cylinder 18 extension direction.

The cylinder 18 may have a stroke of at least 2, 4 or 6 cm and less than 10, 8 or 7 cm, causing the respective pair of fingers 14 to move apart in the X direction a distance of at least 4, 6 or 8 cm and less than 24, 20 or 16 cm in response to the stroke of said cylinder 18. If the fingers 14 are inserted into the opening 33 of the container 32, outward movement of the fingers 14 will cause like opening 33 of the container 32. If desired, the fingers 14 of each pair may move apart until the material of a panel of the container 32 is taut, or opposing panels of the container 32 are taut. The fingers 14 may be rigid and taper towards the distal end, as shown to allow for easier insertion into the opening 33 of the container 32.

The fingers 14 of the claimed invention overcome the need for grippers as are known in the art. Grippers pinch the material therebetween to control the opening 33 of the container 32. But grippers provide the disadvantages that tearing of the flexible container 32 material may occur, a more complex mechanism is required to control pinching of the material therebetween, adjustments of the gripping force must be made to accommodate thickness variations in the material, etc.

The fingers 14 of the present invention further overcome the need for conveyor belts which enter the container 32, as are known in the art. Conveyor belts have a thickness between opposed sides, approximately equal to the pulley width at each end plus approximately double the belt thickness. Such thickness provides the disadvantage that the inside of the belts reduce the width through which sheet goods may pass and the outside of the belts must be accommodated. Such accommodation requires additional material beyond the size of the objects and represents material wastage. Yet a more serious problem with conveyor belts is that the outside faces of the belts may rub or abrade against the inside of the container 32. Such rubbing/abrasion may damage the container 32 material.

Each pair of fingers 14 may be disposed on a carrier plate 20, as noted above. Each carrier plate 20 may articulate about a respective carrier plate 20 axis. The axis may be parallel to the X direction of translation of a pair of fingers 14. This direction may be parallel to the path along which the container 32 is moved and indexed. The carrier plates 20 may articulate so that the fingers 14 move apart in the Y direction a distance of at least 1, 2 or 3 cm but less than 9, 7, or 5 cm.

While two opposed carrier plates 20 are shown, one of skill will recognize the invention is not so limited. Any desired number of carrier plates 20 may be used, with a corresponding finger 14 or pair of fingers 14.

The carrier plates 20 may be spaced apart to provide a conveying space therebetween. The conveying space may allow the clip 30 to pass therethough and move towards/into the container 32.

If an opposed pair of carrier plates 20 is selected, each carrier plate 20 may have a respective carrier plate 20 axis parallel to and aligned with the carrier plate 20 axis of the opposing carrier plate 20. The carrier plates 20 may be articulated about such axes by any known actuating mechanism, such as an electric motor, hydraulic cylinder 18, pneumatic cylinder 18, etc. The actuating mechanism may be directly joined to the carrier plate 20 or may be indirectly connected through a belt drive, gear train, etc.

The carrier plates 20 may articulate in opposing directions to cause separation of the pairs of fingers 14. Such separation may generally be in the Y direction. One of skill will recognize that the Y direction is the predominant direction of movement of the carrier plate 20, even though the movement is through articulation, not translation. If the fingers 14 are inserted in the opening 33 of the flexible container 32, such simultaneous articulation may cause the container 32 opening 33 to be opened and its area maximized in the first direction using plural carrier plates 20.

If the fingers 14 translate outwardly from each other and the carrier plates 20 simultaneously articulate away from each other while the fingers 14 are inserted into the container 32 opening 33, the opening 33 area may be increased in both the first and second directions.

While fingers 14 which translate towards and away from each other in the X direction are described above, one of skill will recognize the invention is not so limited. The fingers 14 may pivot about an axis juxtaposed with the proximal end of the fingers 14, in known fashion. Such pivotal motion results in the distal ends of a pair the fingers 14 moving towards/away from each other in the X direction.

While two carrier plates 20 are shown, each with a respective pair of fingers 14, the invention is not so limited. Two carrier plates 20 may be utilized, but one carrier plate 20 may have one or more stationary fingers 14. The other carrier plate 14 may have one or more movable fingers 14, as described above. The clip 30 may be disposed between the stationary finger(s) 14 and the pair of movable fingers 14. Separation of the moving fingers 14 allows the clip to drop into the container 32.

The first direction and second direction may be mutually perpendicular and define an XY plane. The plane may be generally parallel the plane of the container 32 opening 33.

Figure 4:
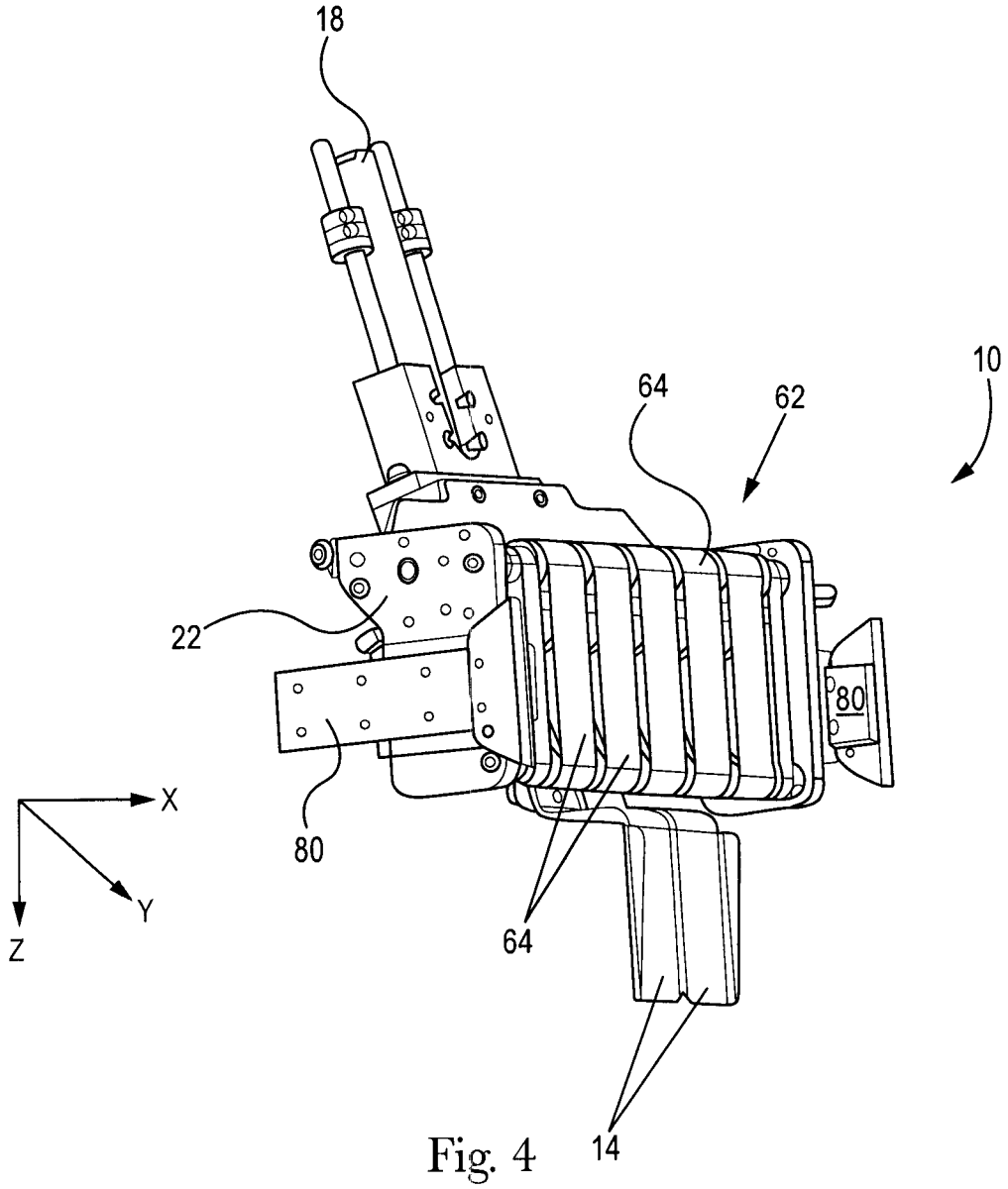
FIG. 4 is a sectional view, taken along line 4-4 of FIG. 1B and not shown the container or first conveying mechanism for clarity.

Referring to FIG. 4, the two carrier plates 20 may be disposed on a mount 22. The mount 22 may translate in the Z direction, perpendicular to the XY plane, so that the carrier plates 20 are movable in the mount 22 direction. The mount 22 may move in the Z-direction and may translate parallel to the longitudinal axes of the fingers 14.

If the mount 22 translates in the Z-direction, parallel to the longitudinal axes of the fingers 14, the carrier plates 20, and likewise the fingers 14, will move in this same direction. This direction may be perpendicular to the plane defined by the first direction and second direction likewise may be perpendicular to the plane of the container 32 opening 33.

The mount 22 may be translated by any known actuating mechanism, such as an electric motor, hydraulic cylinder 18, pneumatic cylinder 18, etc. The mount 22 may slide in a longitudinal slot, oriented parallel to the Z-direction. The actuating mechanism may be directly joined to the mount 22 or may be indirectly connected through a belt 64 drive, gear train, etc. In a degenerate case, the mount 22 may vertically translate, particularly if the fingers 14 are also vertically oriented.

Movement of the mount 22 in the direction of the fingers 14 allows the fingers 14 to enter the opening 33 of the container 32 and retract therefrom. When the fingers 14 are inserted into the container 32, the fingers 14 may then move within the plane of the opening 33 to enlarge the opening 33 and allow for loading of sheet goods therethrough.

Thus, with the device 10, and method of operating such device 10, according to the present invention, the fingers 14 which control the opening 33 of container 32 are capable of independent motion in any of the X, Y and/or Z directions. That is, the fingers 14 are capable of movement in a single X, Y or Z direction, simultaneously movement in any two of the X, Y, Z directions and simultaneous movement in all three of the X, Y, Z directions.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for disposing sheet goods into a flexible container, said device defining mutually orthogonal X, Y, and Z axes extending outwardly from a common origin, said X direction being a conveying direction and said Z direction being a loading direction, said device comprising:

a first conveying mechanism for conveying flexible containers in said X direction relative to said origin;

a second conveying mechanism for conveying the sheet goods in said Z direction relative to said origin;

plural extending fingers, each said finger being cantilevered from a proximal end joined to a movable carrier plate to a distal end remote therefrom; and a mechanism for moving said plural fingers in said mutually orthogonal X, Y and Z directions relative to said origin, while said fingers are at least partially inserted into a flexible container.

2. A device for disposing sheet goods into a flexible container, said device defining mutually orthogonal X, Y, and Z axes extending outwardly from a common origin, said X direction being a conveying direction and said Z direction being a loading direction, said device comprising:

a conveying mechanism for conveying sheet goods in a vertically downward direction;

first and second opposed articulable carrier plates, said first and second opposed articulable carrier plates defining a conveying space therebetween;

each of said first and second opposed articulable carrier plates having a pair of downwardly extending fingers joined thereto, each said finger being cantilevered from a proximal end juxtaposed with a respective opposed articulable carrier plate and extending to a respective distal end remote therefrom and defining a longitudinal axis from said proximal end to said distal end;

at least one mount, said at least one mount holding said first and second opposed articulable carrier plates, said at least one mount being movable in said Z direction;

a pair of finger moving mechanisms for moving said pairs of fingers towards and away from each other in said X direction; and a carrier plate moving mechanism for moving said first and second opposed articulable carrier plates towards and away from each other in said Y direction, a mount moving mechanism for moving said at least one mount back and forth in said Z direction, whereby said fingers can simultaneously move in said X, Y and Z directions relative to said common origin.

3. A device according to claim 1 wherein said plural fingers are capable of simultaneous movement relative to said origin in said mutually orthogonal X, Y and Z directions.

4. A device according to claim 3 comprising four fingers wherein said fingers are disposed in two pairs, with each said pair having a first finger and a second finger, said first finger and said second finger of each said pair being capable of simultaneously translating away from the other said finger.

5. A device according to claim 4 wherein a first said finger of one said pair is oppositely disposed from a respective first said finger of said other pair, said first finger of one said pair and said first finger of said other pair are capable of articulably moving away from each other.

6. A device according to claim 4 wherein each said finger of said pairs of fingers defines a longitudinal axis from each said proximal end thereof to each said respective distal end thereof, said longitudinal axes defining a common longitudinal Z direction, said plural fingers being capable of moving in unison relative to said origin in said longitudinal Z direction.

7. A device according to claim 2 wherein said conveying mechanism comprises at least one pair of opposed belts having a space therebetween for conveying sheet goods therethrough.

8. A device according to claim 7 comprising a finger moving mechanism for each said pair of fingers, wherein each said finger moving mechanism is capable of moving each said finger of a said pair of fingers towards each other and away from each other in said X direction, each said finger moving mechanism comprising a pneumatic cylinder, said cylinder having a first end pivotally connected to two links, each said link having a first end pivotally connected to said cylinder and a second end remote therefrom, each said second end being connected to a respective said finger, whereby extension and retraction of said cylinder in a first direction causes said fingers of said respective pair to move away from and towards each other, respectively.

9. A device according to claim 8 wherein said two links of a said pair of fingers are symmetrically oppositely disposed about said cylinder.

10. A device according to claim 9 wherein said first plate and said second plate are each articulable about a first plate axis and a second plate axis, respectively, said first plate axis and said second plate axis being parallel to said X axis.

11. A device according to claim 10 wherein each of said first and second opposed articulable carrier plates has a respective proximal end juxtaposed with said respective plate axis and a respective distal end remote therefrom and disposed towards said first conveying mechanism.

12. A device according to claim 11 wherein each said cylinder has a stroke ranging from 4 to 8 cm, and said fingers of a respective said pair of fingers move apart a distance of 6 to 20 cm in response to said stroke of said cylinder.

13. A device according to claim 12 wherein said fingers are capable of movement in said Z direction relative to said origin while each of said fingers of said pair of said fingers simultaneously moves away from the other finger of said pair.

14. A device according to claim 12 wherein said plates are capable of articulating about said respective plate axes, while each of said fingers of said pair of said fingers simultaneously moves away from the other finger of said pair.

* * * * *